United States Patent [19]

Wheatley et al.

[11] 4,398,398

[45] Aug. 16, 1983

[54] ACOUSTICAL HEAT PUMPING ENGINE

[75] Inventors: John C. Wheatley; Gregory W. Swift, both of Los Alamos; Albert Migliori, Santa Fe, all of N. Mex.

[73] Assignee: The United States of America as represented by the U.S. Department of Energy, Washington, D.C.

[21] Appl. No.: 292,979

[22] Filed: Aug. 14, 1981

[51] Int. Cl.[3] ..... F25B 21/02

[52] U.S. Cl. ..... 62/467 R; 62/6; 60/721

[58] Field of Search ..... 60/516, 517, 650, 682, 60/721; 62/6, 118, 467 R; 116/DIG. 22, 137 R

[56] References Cited

U.S. PATENT DOCUMENTS

| | | | |
|---|---|---|---|
| 2,836,033 | 5/1958 | Marrison | 60/516 |
| 3,006,154 | 10/1961 | Brandon | 62/118 X |
| 3,237,421 | 3/1966 | Gifford | 62/6 X |
| 4,114,380 | 9/1978 | Ceperly | 60/721 |

OTHER PUBLICATIONS

Transactions of the American Society of Mechanical Engineers, "Pulse-Tube Refrigeration", Gifford W. E. and Kyanka, G. H., Aug. 1964, pp. 264-268.

*Advances in Cryogenic Engineering*, vol. 12, "Reversible Pulse Tube Refrigeration", Gifford, W. E., and Kyanka, G. H., (Plenum Press, New York, 1967) pp. 619-630.

*Advances in Cryogenic Engineering*, vol. 11, "Surface Heat Pumping", Gifford, W. E. and Longsworth, R. C., (Plenum Press, New York, 1966) pp. 171-179.

Journal of the Acoustical Society of America, vol. 66, No. 5, "A Pistonless Stirling Engine-The Traveling Wave Heat Engine", Ceperly, P. H., pp. 1508-1513.

*Advances in Cryogenic Engineering*, vol. 10, "Pulse Tube Refrigeration Progress", Gifford, W. E. and Longsworth, R. C. (Plenum Press, New York, 1965) pp. 69-79.

*Advances in Cryogenic Engineering*, vol. 12, "An Experimental Investigation of Pulse Tube Refrigeration Heat Pumping Rates", Longsworth, R. C., (Plenum Press, New York, 1967) pp. 608-618.

*Primary Examiner*—Allen M. Ostrager
*Assistant Examiner*—Stephen F. Husar
*Attorney, Agent, or Firm*—Paul D. Gaetjens; William A. Eklund; Richard G. Besha

[57] ABSTRACT

The disclosure is directed to an acoustical heat pumping engine without moving seals. A tubular housing holds a compressible fluid capable of supporting an acoustical standing wave. An acoustical driver is disposed at one end of the housing and the other end is capped. A second thermodynamic medium is disposed in the housing near to but spaced from the capped end. Heat is pumped along the second thermodynamic medium toward the capped end as a consequence both of the pressure oscillation due to the driver and imperfect thermal contact between the fluid and the second thermodynamic medium.

10 Claims, 2 Drawing Figures

ACOUSTICAL HEAT PUMPING ENGINE

This invention is the result of a contract with the Department of Energy (Contract No. W-7405-ENG-36).

BACKGROUND OF THE INVENTION

The field of the invention relates to heat pumping engines and more particularly to acoustical heat pumping engines without moving seals.

An important task for a heat engine is the pumping of heat from one thermal reservoir at a first temperature to a second thermal reservoir at a second higher temperature by the expenditure of mechanical work. A Stirling engine is an example of a device which, when used with an ideal gas, can pump heat reversibly. Such an engine has two mechanical elements, a power piston and a displacer, the motions of which are phased with respect to one another to achieve the desired result. W. E. Gifford and R. C. Longsworth describe in an article entitled, "Pulse-Tube Refrigeration" which appeared August 1964 in the Transactions of the ASME on pp. 264–268, an intrinsically irreversible engine which they call a pulse-tube refrigerator or a surface heat pumping refrigerator which, in principle, requires only one moving element and which achieves the necessary phasing between temperature changes and fluid velocity by using the time delay for thermal contact between a primary gas medium and a second thermodynamic medium, in their case the walls of a stainless steel tube. The Gifford and Longsworth device utilizes, instead of a power piston, a rotating valve which cyclically at a rate of about 1 Hz connects their tube to high and low pressure reservoirs maintained by a compressor. Apparatus in accordance with the present invention utilizes the surface heat pumping principle but increases the frequency of operation by a factor of about one hundred over the frequency of the Gifford and Longsworth device. The present invention utilizes not a compressor, but an acoustical driver, thereby eliminating all moving seals and any need for external mechanical inertial devices such as flywheels.

One prior art device of interest is a traveling wave heat engine described in U.S. Pat. No. 4,114,380 to Ceperley. This device utilizes a compressible fluid in a tubular housing and an acoustical traveling wave. Thermal energy is added to the fluid on one side of a second thermodynamic medium and thermal energy is extracted from the fluid on the other side of the second thermodynamic medium. The material between the two sides is retained in approximate thermal equilibrium with the fluid, thereby causing a temperature gradient in the fluid to remain essentially stationary. The operation of this device is different from that of the instant invention in several respects. The device of this reference uses traveling acoustical waves for which the local oscillating pressure p is necessarily equal to the product of the acoustical impedance $\rho c$ and the local velocity v at every point of the engine while the instant invention uses standing acoustical waves for which the condition $p >> \rho cv$ can be achieved in the vicinity of the second thermodynamic medium, thereby enhancing the ratio of thermodynamic to viscously dissipative effects. Traveling waves require that no reflections occur in the system; such a condition is difficult to achieve because the second medium acts as an obstacle which tends to reflect the waves. Additionally, a thermodynamically efficient pure traveling wave system is more difficult to achieve technically than a standing wave system. The '380 invention also requires that the primary fluid be in excellent local thermal equilibrium with the second medium. This has the effect of making it closely analogous to the Stirling engine. However, the requirement on the fluid geometry necessary to give good thermal equilibrium together with the requirement that $p=\rho cv$ for a traveling wave imposes necessarily a large viscous loss (excepting fluids of exceedingly low Prandtl number that are unknown). The present invention utilizes imperfect thermal contact with the second medium as an essential element of the heat pumping process. As a consequence, an engine in accordance with the invention need not necessarily have the high viscous losses of the '380 traveling wave engine.

U.S. Pat. No. 3,237,421 to Gifford describes the surface heat pumping device discussed in the previously cited article by Gifford and Longsworth. The instant invention differs from the '421 device not only as described above but also in that the regenerator required between the pressure source and the surface heat pumping part of the '421 apparatus is not needed in the instant invention. Indeed, including such a regenerator in the instant invention would degrade its performance as a consequence of the same viscous heating problems that characterize the '380 invention. Too, Gifford requires a large and necessarily heavy compressor whereas the instant invention is light weight, requiring no such compressor. The Gifford device also requires moving seals while the instant invention does not.

SUMMARY OF THE INVENTION

One object of the invention is to provide refrigeration and/or heating without the necessity of moving seals.

Another object of the invention is to eliminate the need for external mechanical inertial devices such as fly wheels in a refrigerating or heating apparatus.

Another object of the invention is to increase the frequency of operation thereof far above that typical for most mechanical apparatus.

In accordance with the present invention there is provided an acoustical heat pumping engine comprising a tubular housing, such as a straight, U- or J-shaped tubular housing. One end of the housing is capped and the housing is filled with a compressible fluid capable of supporting an acoustical standing wave. The other end is topped with a device such as the diaphragm and voice coil of an acoustical driver for generating an acoustical wave within the fluid medium. In a preferred embodiment a device such as a pressure tank is utilized to provide a selected pressure to the fluid within the housing. A second thermodynamic medium is disposed within the housing near but spaced from the capped end to receive heat from the fluid moved therethrough during the pressure increase portion of a wave cycle and to give up heat to the fluid as the pressure of the gas decreases during the appropriate part of the wave cycle. The imperfect thermal contact between the fluid and the second medium results in a phase lag different from 90° between the local fluid temperature and its local velocity. As a consequence there is a temperature differential across the length of the medium and in the case of the preferred embodiment essentially across the length of the shorter stem of the J-shaped housing. Heat sinks and/or heat sources can be incorporated for use with the device of the invention as appropriate for refrigerating and/or heating uses.

One advantage of the instant invention is that it is easy to build and simple and inexpensive to operate and maintain.

Another advantage of the instant invention is that it uses no moving seals and has only one moving part.

Yet another advantage of the present invention is that an apparatus in accordance therewith is compact and lightweight.

Still another advantage of the instant invention is that it can be used to heat or refrigerate over selected temperature ranges from cryogenic temperatures through very hot temperatures depending upon the materials, pressures, and frequencies utilized.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF A PREFERRED EMBODIMENT OF THE INVENTION

Figures 1, 2:
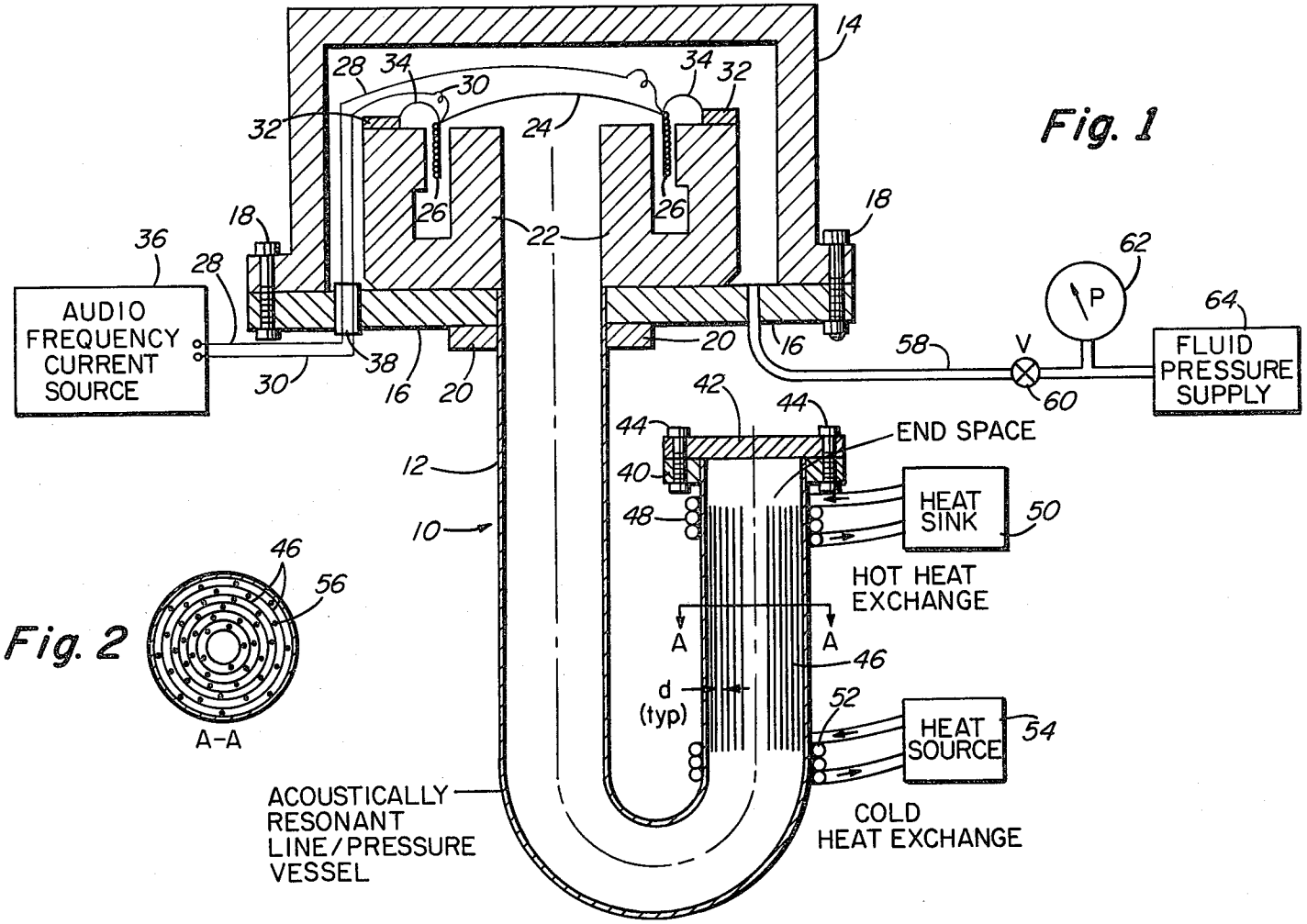
FIG. 1 shows a cross sectional view of a preferred embodiment of the invention.
FIG. 2 shows a cutaway view of a second thermodynamic medium utilized in the preferred embodiment of the invention.

A preferred embodiment of the invention 10 is illustrated in FIG. 1 and comprises a J-shaped generally cylindrical or tubular housing 12 having a U-bend, a shorter stem and a longer stem. The longer stem is capped by an acoustical driver container 14 supported on a base plate 16 and mounted thereto by bolts 18 to form a pressurized fluid-tight seal between base plate 16 and container 14. Base plate 16 in the preferred embodiment sits atop a flange 20 extending outwardly from the wall of housing 12. Acoustical driver container 14 encloses a magnet 22, a diaphragm 24, and a voice coil 26. Wires 28 and 30 passing through a seal 38 in base plate 16 extend to an audio frequency current source 36. The voice coildiaphragm assembly is mounted by a flexible annulus 34 to a base 32 affixed to magnet 22. It will be appreciated by those skilled in the art that the acoustical driver illustrated is conventional in nature. In the preferred embodiment the driver operates in the 400 Hz range. However, in the preferred embodiment, from 100 to 1000 Hz may be used. In the preferred embodiment helium was utilized to fill vessel 12 but again one skilled in the art will appreciate that other fluids such as air and hydrogen gas or liquids such as freons, propylene, or liquid metals such as liquid sodium-potassium eutectic may readily be utilized to practice the invention. A flange 40 is affixed atop the shorter stem by, for example, welding it thereto. An end cap 42 is disposed atop flange 40 and is affixed thereto by bolts 44 to form a pressurized fluidtight seal. A second thermodynamic medium, which in the preferred embodiment is seen in cross section in FIG. 2, preferably comprises concentric cylinders, a spiral, or parallel plates of a material such as Mylar, Nylon, Kapton, an epoxy, thin-walled stainless steel and the like. The material used must be capable of heat exchange with the fluid within housing 12. Any solid substance for which the effective heat capacity per unit area at the frequency of operation is much greater than that of the adjacent fluid and which has an adequately low longitudinal thermal conductance will function as a second thermodynamic medium. The little dots 56 seen in FIG. 2 may be dimpling or other means utilized to maintain the concentric cylinders, spirals, or parallel plates approximately equi-spaced from one another. It should be noted that there is an end space between end cap 42 and the top of thermodynamic medium 46. The housing 12 in the vicinity of the end space and the top of medium 46 communicate with a heat sink 50 via conduit 48, providing hot heat exchange. On the housing 12 at the lower end of the thermodynamic medium 46 a second conduit 52 communicates with a heat source 54 and provides a cold heat exchange.

A desired or selected pressure is provided through a conduit 58 and valve 60 from a fluid pressure supply 64. The pressure may be monitored by a pressure meter 62.

The acoustical driver assembly, having the permanent magnet 22 providing a radial magnetic field which acts on currents in the voice coil 26 to produce the force on the diaphragm 24 to drive acoustical oscillations within the fluid, is mechanically coupled to housing 12, a J-tube shaped acoustical resonator having one end closed by end cap 42. In a typical device the resonator may be nearly a quarter wavelength long at its fundamental resonance, but those skilled in the art will appreciate that this is not crucial. No mechanical inertial device is needed as any necessary inertia is provided by the primary fluid itself resonating within the J-tube. The second thermodynamic medium comprising layers 46 should have small longitudinal thermal conductivity in order to reduce heat loss. In the preferred embodiment the spacing between concentric tubes 46 is of uniform thickness d. Another requirement of the second medium is that its effective heat capacity per unit area $C_{A2}$ should be much greater than that, $C_{A1}$, of the adjacent primary medium. These qualities are represented mathematically as follows.

$$C_{A1}=C_1(d/2);\ C_{A2}=C_2\delta_2$$

where $C_1$ and $C_2$ are the heat capacities per unit volume, respectively, of the primary fluid medium and the second solid medium 46 and $\delta_2=(2\kappa_2/\omega)^{\frac{1}{2}}$, $\delta_2$ being the thermal penetration depth into the second medium of thermal diffusivity $\kappa_2$, at angular frequency $\omega=2\pi f$, where f is the acoustical frequency. The condition $C_{A2}>>C_{A1}$ is readily achieved, together with low longitudinal heat loss, if the second medium is a material like Kapton, Mylar, Nylon, epoxies or stainless steel for frequencies of a few hundred Hertz at a helium gas pressure of about 10 atm. For efficient operation, it is necessary that viscous losses be small. This can be achieved if $L/\lambda\!\!\!^{-}<<1$, where L is the length of the second medium and $\lambda\!\!\!^{-}$ is the radian length of the acoustical wave given by $\lambda\!\!\!^{-}=\lambda/2\pi=c/2\pi f$ where c is the velocity of sound in the fluid medium. In sizing the engine, one picks a reasonable L and then picks a general frequency from $L/\lambda\!\!\!^{-}<<1$. For an L of about 10 to 15 cm. a reasonable frequency is 300 to 400 Hz for helium near room temperature. The spacing d is then determined approximately by the requirement $\omega\tau_\kappa\simeq 1$ needed to get the necessary temperature variations and the necessary phasing between temperature changes and primary fluid velocity. Here $\tau_\kappa$ is the diffusive thermal relaxation time given for a parallel plate geometry by $$\tau_\kappa = \frac{d^2}{\pi^2 \kappa_1},$$

where $\kappa_1$ is the thermal diffusivity of the primary fluid medium. For gases, $\kappa$ is roughly inversely proportional to pressure. The spacing d is then determined approximately by the inequality $$d \gtrsim \left(\frac{\pi^2 \kappa_1}{\omega}\right)^{\frac{1}{2}}.$$

A pressure of 10 atm with helium gas gives quite reasonable values for d, i.e., about 10 mils.

These considerations are typical in sizing the engine. Referring to FIG. 1 the operation is as follows. The acoustical driver is mounted in a vessel to withstand the working fluid pressure and is mechanically coupled in a fluid-tight way to the resonator, J-shaped tubing 12. Current leads from the voice coil are brought through seal 38 to an audio frequency current source 36. The acoustical system has been brought up to pressure p through valve 60 using fluid pressure supply 64. The frequency and amplitude of the audio frequency current source are selected to produce the fundamental resonance corresponding to a quarter wave resonance in the J-shaped tube 12. A driver such as a JBL 2482 manufactured by James B. Lansing Sound, Inc. will readily produce in $^4$He gas a one atm peak to peak pressure variation at end cap 42 when the average pressure within the housing is about 10 atm.

Since the length of the medium 46 is much less than $\lambda\!\!\!^{-}$, the pressure is nearly uniform over the second thermodynamic medium. The effects there are thus essentially the same as they would have been with an ordinary mechanical piston and cylinder arrangement producing the same pressure variation at this high frequency.

Heat pumping action is as follows. Consider a small bit of fluid near the second medium at an instant when the oscillatory pressure is zero and going positive. As pressure increases the bit of fluid moves toward the end cap 42 and warms as it moves. With a time delay $\tau_\kappa$, heat is transferred to the second medium from the hot bit of fluid after the fluid has moved toward the end cap from its equilibrium position, thereby transferring heat toward the end cap. The pressure then decreases, and therewith, the temperature decreases. However, this temperature decrease is not communicated to the second medium until the same bit of fluid has moved a significant distance from its equilibrium position away from end cap 42 toward the U-bend, thereby transferring cold toward the U-bend. There is hence a net transfer of heat from the bottom to the top of the thermal lag space. Cooling at the bottom will continue until the temperature gradient and losses are such that as the fluid moves, the second medium temperature matches that of the adjacent moving fluid. Adjustment of the size of the end space below the end cap determines the volumetric displacement of the fluid at the end of the thermal lag space and hence plays an important role in determining the amount of heat pumped. Note that since the bottom is cold the J-tube arrangement shown is gravitationally stable with respect to natural convection of the primary fluid. If an apparatus in accordance with the invention is constructed to operate in a gravity-free environment, such as outer space, the J-shape of the tube will be unnecessary. The J-shape of the tube 12 can also be modified, as can its attitude, if some degradation of performance is acceptable. For example, straight and U-shaped tubes may be utilized.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application, to thereby enable others skilled in the art to best utilize the invention in various embodiments and with various modifications as are suited to the particular use contemplated. It is intended that the scope of the invention be defined by the claims appended hereto.

What is claimed is:

1. An acoustical heat pumping engine having no moving seals comprising:

a housing essentially resonant at a selected frequency having first and second ends;

means for capping said first end of said housing;

a compressible fluid capable of supporting an acoustical standing wave disposed within said housing;

means for providing a selected pressure to said fluid within said housing;

means disposed at said second end of said housing for cyclically driving said fluid with an acoustical standing wave substantially at said selected frequency; and a second thermodynamic medium disposed within said housing near to but spaced from said capping means, whereby energy continually flows toward said capping means when said engine operates.

2. The invention of claim 1 further comprising means for transferring heat from said housing near said capping means to heat sink means.

3. The invention of claim 1 further comprising means for cooling an external medium operably communicating with said housing at a region thereof at the other side of said second thermodynamic medium from said capping means.

4. The invention of claim 1 wherein said housing comprises a straight tube.

5. The invention of claim 1 wherein said housing comprises a U-bend.

6. The invention of claim 1 wherein said selected frequency is at least about 100 hertz.

7. The invention of claim 1 wherein said selected frequency is from about 100 to about 1000 hertz.

8. The invention of claim 1 wherein said housing is J-shaped having a short stem and a long stem.

9. The invention of claim 8 wherein said capping means is disposed at said short stem end and said driving means is disposed at the long stem end.

10. The invention of claim 9 wherein said second thermodynamic means is disposed in said short stem.

* * * * *